US011761307B2

(12) United States Patent
Moreira Da Silva et al.

(10) Patent No.: US 11,761,307 B2
(45) Date of Patent: Sep. 19, 2023

(54) REMOTE AND AUTONOMOUS CHEMICAL TREATMENT SYSTEM FOR APPLICATION IN PRODUCING WELLS OF OFFSHORE PLATFORMS

(71) Applicant: Petróleo Brasileiro S.A.—Petrobras, Rio de Janeiro (BR)

(72) Inventors: Fernando Antonio Moreira Da Silva, Rio de Janeiro (BR); Paulo Henrique De Amorim Martins, Rio de Janeiro (BR); Jose Sergio Daher, Macaé (BR); Mario Germino Ferreira Da Silva, Rio de Janeiro (BR); Thiago Geraldo Da Silva, Macaé (BR); Caio Mezencio Pimenta, Belo Horizonte (BR)

(73) Assignee: Petróleo Brasileiro S.A.—Petrobras, Rio de Janeiro (BR)

( * ) Notice: Subject to any disclaimer, the term of this patent is extended or adjusted under 35 U.S.C. 154(b) by 0 days.

(21) Appl. No.: 17/957,809

(22) Filed: Sep. 30, 2022

(65) Prior Publication Data

US 2023/0106902 A1 Apr. 6, 2023

(30) Foreign Application Priority Data

Oct. 1, 2021 (BR) ..... 10 2021 019813 3

(51) Int. Cl.
*E21B 37/06* (2006.01)

(52) U.S. Cl.
CPC ..... *E21B 37/06* (2013.01)

(58) Field of Classification Search
CPC ..... E21B 37/06
See application file for complete search history.

(56) References Cited

U.S. PATENT DOCUMENTS

| | | | | |
|---|---|---|---|---|
| 9,309,750 | B2 * | 4/2016 | Coonrod | E21B 33/076 |
| 2017/0198552 | A1 * | 7/2017 | August | B01D 3/00 |

FOREIGN PATENT DOCUMENTS

| | | | |
|---|---|---|---|
| BR | PI0703552 | A2 | 4/2009 |
| BR | PI0900725 | A2 | 12/2010 |
| BR | 102015013833 | A2 | 3/2017 |
| BR | 102020016720 | A2 | 3/2022 |

* cited by examiner

*Primary Examiner* — Matthew R Buck
(74) *Attorney, Agent, or Firm* — Mintz Levin Cohn Ferris Glovsky and Popeo, P.C.

(57) ABSTRACT

The present invention addresses to a remote and autonomous chemical treatment system for application in producing wells of offshore platforms aiming at treatments for removal and prevention of production string fouling, selective completion system, well safety equipment (DHSV, HFIV) and rock formation. The purpose of this invention is to completely replace the stimulation boat, thus allowing treatments to be carried out with resources from the routine operational contracting of the offshore production unit.

7 Claims, 1 Drawing Sheet

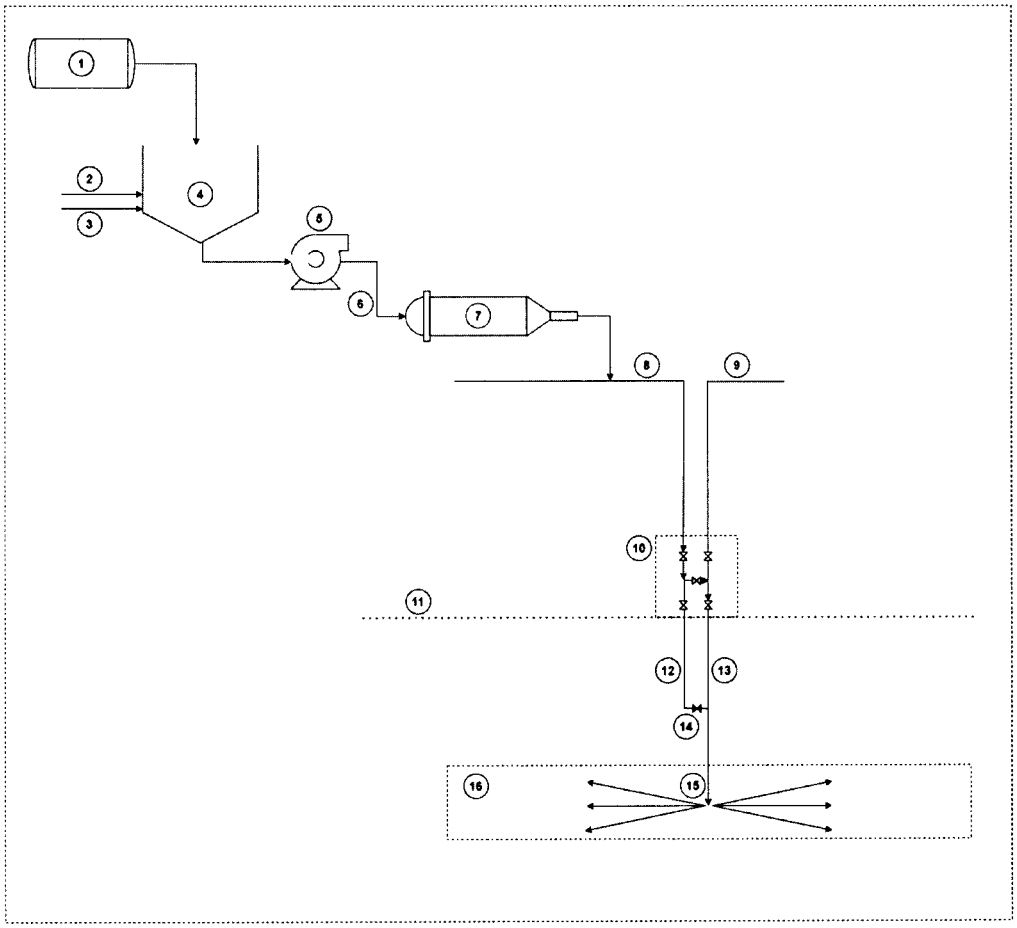
1
2
3
4
5
6
7
8
9
10
11
12
13
14
15
16

REMOTE AND AUTONOMOUS CHEMICAL TREATMENT SYSTEM FOR APPLICATION IN PRODUCING WELLS OF OFFSHORE PLATFORMS

CROSS-REFERENCE TO RELATED APPLICATION

This application claims priority to Brazilian Application No. 10 2021 019813 3 filed on Oct. 1, 2021, and entitled "REMOTE AND AUTONOMOUS CHEMICAL TREATMENT SYSTEM FOR APPLICATION IN PRODUCING WELLS OF OFFSHORE PLATFORMS," the disclosure of which is incorporated herein by reference in its entirety.

FIELD OF THE INVENTION

The present invention addresses to a remote and autonomous chemical treatment system applied in producing wells of offshore platforms, aiming at eliminating the use of stimulation boat and reducing operational risks, as well as operational costs.

DESCRIPTION OF THE STATE OF THE ART

Currently, there is a need to use a stimulation boat to perform remote chemical treatments (without the intervention of rigs). The cost of the stimulation vessel alone is estimated at around 2 million dollars. In the production history of carbonate wells, there is a need for acidification treatments. Initially, the occurrence of evaporite scaling induced in the production strings was verified due to the injection of dehydrated gas used as a lifting method (gas lift). As of 2016, the process of blocking of the wells became severe, requiring acidification every one or two months. Thus, the use of industrial water was made to remove evaporite deposits, which was achieved by making industrial water available for direct injection into the producing well. As of 2018, the use of a scale inhibitor was also introduced, allowing for an extension of the treatment duration.

However, the frequency of treatments using stimulation boats has become very high in offshore units, due to the limited capacity of serving of stimulation vessels. With this, the Stationary Production Unit (SPU) verified the need to adapt its own surface facilities to carry out autonomous chemical treatments, with the motivation of developing a system that would allow the performance of chemical treatments in producing wells independently of critical resources, such as the stimulation boat.

Document PI0900725-3 discloses a system and methods aimed at chemical cleaning of a subsea system and well equipment, but its application is limited only to the treatment via gas lift, not allowing applications for different purposes of production or injection of fluids (liquid, gas or mixtures), as it is not intended to completely replace the stimulation boat.

Document PI0703532-2 discloses a method of cleaning flexible lines in an offshore environment for the reuse of these flexible lines in new oil well production projects, that is, it refers exclusively to treatments of subsea lines, not having as an objective production string scale removal and prevention treatments, selective completion system, well and rock formation safety equipment (DHSV, HFIV).

Document BR102015013833-4 discloses a system applied exclusively to treatments of subsea lines coupled with SESP system. These systems are subject to fouling in the pump bearing of the SESP system. In this case, the reservoir does not have enough energy to maintain the sustained production of the produced fluid, so the centrifugal mechanical pump is used, becoming a system applied to a very restricted scenario.

Document BR102020016720-0 refers to a method to be implemented to remove saline scale effectively solubilized by the use of industrial water. However, his method is not an autonomous method, since chemical treatments are carried out by stimulation vessels.

It is common in the oil industry for the subsea system to have similar arrangements (for example, subsea pipelines, WCT—Wet Christmas Tree, well platform interconnection lines, injection or suction pump etc.), and this subsea system can be used for different purposes of production or injection of fluids (liquid, gas or mixtures).

In view of this, no document of the state of the art discloses a remote and autonomous chemical treatment system exclusive for application in producing wells of offshore platforms such as the one of the present invention.

Thus, in order to solve such problems, the present invention is devised by carrying out chemical treatments without the use of stimulation boats, thus eliminating the need to use a critical resource with restricted availability and thereby increasing operational safety during well interventions.

The present invention focuses on the use of a proprietary offshore platform system for acidification, removal and inhibition of incrustations in wells, in which it allows to dispense with the critical resource of the stimulation boat and other operational risks with this type of vessel, in addition to significantly saving on operating costs, thereby mitigating and preventing fouling losses in producing wells where intervention with a stimulation boat is necessary, thus allowing for an increase in the field recovery factor and an increase in operational efficiency.

Further, the present invention presents a lower risk with the interference of the stimulation vessel with other operations in parallel and a lower risk of accidents with air boarding and weather conditions (wind, wave) that threaten operations with maritime vessels of the type WSSV (Well Stimulation Support Vessel).

BRIEF DESCRIPTION OF THE INVENTION

The present invention addresses to a remote and autonomous chemical treatment system with the objective of completely replacing the stimulation boat, thus allowing the treatment with contracting resources of the operational routine of the offshore production unit.

The invention can be applied not only to the chemical removal process, but to the prevention of fouling and specific treatments that also include the treatment of the section of the production string below the gas lift valve and the rock formation.

BRIEF DESCRIPTION OF DRAWINGS

The present invention will be described in more detail below, with reference to the attached FIGURES which, in a schematic form and not limiting the inventive scope, represent examples of its embodiment. In the drawings, there is:

FIG. 1 illustrating a schematic drawing of a system with LGL injection according to the present invention, where there are represented: (1) chemical product container, (2) industrial water intake, (3) diesel intake, (4) pumping unit tank, (5) pumping unit, (6) chiksan lines, (7) PIG launcher/receiver, (8) gas lift line/well production line, (9) well production line, (10) well wet Christmas tree, (11) mudline, (12) well annular, (13) well production string, (14) gas lift valve, (15) perforations, and (16) reservoir.

DETAILED DESCRIPTION OF THE INVENTION

The remote and autonomous chemical treatment system according to the present invention and illustrated in FIG. 1 allows the adaptation and use of facilities of the offshore production unit of industrial water or treated injection systems, and diesel both available in routine operations of the offshore unit to carry out chemical treatment of wells without the assistance of stimulation vessels.

As can be seen in FIG. 1, in the tank (4), there are injected, depending on the type of treatment to be performed in the subsea production system (treatment of production strings, subsea line systems and reservoir rock), the scale inhibitor and/or other water soluble chemical products (scale remover—acids or chelators; chemical diverter or damage controllers), (1), industrial or injection water (water intake—2) for preparing the aqueous cushion treatment and displaced with diesel (diesel intake —3).

The pumping unit (5) takes the prepared fluid through chicksan lines (6) to the intake of the PIG receiver or launcher (7) and injects the prepared cushion continuously or in batches into the gas lift line (8) or in the production line (9), depending on the available alignment. Through the production string and valves of the Christmas Tree (10), the prepared cushion is injected by "bullheading" through the perforations (15) in the reservoir rock (16).

The system of the present invention can be applied to producing rock formations and fluid composition, taking advantage of the chemical products already in use in the offshore unit, such as demulsifiers, asphaltene inhibitors, corrosion inhibitors, chemical diverter, damage controllers or chemical product soluble in industrial water or treated injection water.

In addition, the system of the present invention can be adapted for treatment of offshore injection wells for damage removal with remote acidification, by changing the interconnection of the remote and autonomous chemical treatment system to the water injection system.

EXAMPLES

The following examples are presented in order to more fully illustrate the nature of the present invention and the manner of practicing the same, without, however, being considered as limiting its content.

Example 1: Procedure with Scale Inhibitor

Well operating by gas lift; pumping the cushions preferably at the maximum possible flow rate; required volume of diesel: ~1,600 bbl (190.78 $m^3$); required volume of industrial water: ~1,000 bbl (119.24 $m^3$); required volume of inhibitor: 1,000 liters.

With the offshore injection lines filled with diesel, align the system to the wellhead, via the production header, the service line interconnected via the chicksan line to the treatment cushion preparation tank.

Pressurize the lines with industrial water and prepare the cushion batch with inhibitor (addition of the inhibitor to the tank water). Align the treatment cushion through the service line to the wellhead (via the pig receiver) and proceed with the treatment injection.

Repeat the treatment injection batch if necessary. Carry out all displacement of aqueous fluid to rock formation to prevent hydrate/meet well integrity restriction with diesel pumping.

Example 2: Economic Valuation for Autonomous Removals and Inhibitions

Table 1 presents a comparison of costs per operation using rig/boat and autonomous treatment, where there is a large total reduction of costs resulting from autonomous treatments when compared to treatments using rig and stimulation boat.

TABLE 1

Calculation of NPV (Net Present Value).

| NPV in US$ millions | NPV/TREAT | R/C | NPV/TREAT | R/C |
|---|---|---|---|---|
| | Rig and Boat | | Autonomous treatments | |
| Removal | 3.57 | 1.34 | 4.32 | 1.44 |
| Removal and inhibition | 0.92 | 1.25 | 2.78 | 2.50 |
| TOTAL | 4.49 | 2.59 | 7.10 | 3.94 |

Key:
TREAT = treatment.

Table 1 reports the cost/benefit ratio in terms of saving the value of barrels of oil considering the relationship with conventional treatment (rig and boat) and the use of an autonomous treatment by the offshore production unit. For the case of autonomous removal and inhibition, there is a 100% return compared to a conventional treatment (double the value of the return to cost ratio—R/C).

It should be noted that, although the present invention has been described in relation to the attached drawings, it may undergo modifications and adaptations by technicians skilled on the subject, depending on the specific situation, but provided that it is within the inventive scope defined herein.

The invention claimed is:

1. A remote and autonomous chemical treatment system for application in producing wells of offshore platforms, the system comprising:

- a tank configured to receive a fluid comprising a chemical product, industrial water, and diesel;
- a pumping unit configured to receive the fluid from the tank and pump the fluid;
- a pig receiver or launcher configured to receive fluid from the pump by lines connecting the pump to an inlet of the pig receiver or launcher;
- a lift gas line or a production line arranged to receive the fluid from an outlet of the pig receiver or launcher;
- a Christmas tree arranged to receive the fluid from the lift gas line or the production line; and
- a production string arranged to receive fluid from the Christmas Tree and direct the fluid towards perforations in reservoir rock, wherein the pumping unit provides sufficient pressure and flowrate to bullhead the fluid through the perforations and into the reservoir rock.

2. The system according to claim 1, wherein the tank and the pumping unit are on an offshore production platform, and wherein the lift gas line or the production line and the production string extend between the offshore production platform and the Christmas tree.

3. The system according to claim 1, wherein the fluid comprises a chemical product.

4. The system according to claim 3, wherein the chemical product comprises scale inhibitors, scale removers, chemical diverters, or damage controllers.

5. The system according to claim 1, wherein the pumping unit is configured to inject the fluid continuously or in batches.

6. The system according to claim 1, wherein the fluid comprises demulsifiers, asphaltene inhibitors, corrosion inhibitors, chemical diverter, damage controllers or a chemical soluble in industrial water or treated injection water.

7. The system according to claim 1, wherein the system is configured to treat injector offshore wells to remove damage with remote acidification.

* * * * *